US007139012B2

(12) United States Patent
Inukai

(10) Patent No.: US 7,139,012 B2
(45) Date of Patent: Nov. 21, 2006

(54) IMAGE FORMING DEVICE HAVING MULTIPLE LASER BEAM SOURCES

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 251 days.

(21) Appl. No.: 10/879,177

(22) Filed: Jun. 30, 2004

(65) Prior Publication Data

US 2005/0036026 A1 Feb. 17, 2005

(30) Foreign Application Priority Data

Jun. 30, 2003 (JP) ..... 2003-188992

(51) Int. Cl.
*B41J 2/435* (2006.01)

(52) U.S. Cl. ..... 347/236; 347/246

(58) Field of Classification Search ..... 347/236, 347/246

See application file for complete search history.

(56) References Cited

U.S. PATENT DOCUMENTS 5,965,869 A 10/1999 Masuda et al.
6,427,061 B1 * 7/2002 Miura et al. ..... 399/336
6,445,670 B1 * 9/2002 Oshima ..... 369/116
2001/0020670 A1 * 9/2001 Hyoga ..... 250/205
2001/0046242 A1 * 11/2001 Kawakami et al. ..... 372/38.02
2002/0075917 A1 * 6/2002 Suda ..... 372/38.01

FOREIGN PATENT DOCUMENTS

JP A 10-166649 6/1998
JP A 11-101947 4/1999

* cited by examiner

*Primary Examiner*—Hai Pham
*Assistant Examiner*—Kainoa B K Wright
(74) *Attorney, Agent, or Firm*—Oliff & Berridge, PLC

(57) ABSTRACT

An image forming device employs a multi-laser beam system in which the light intensity of the second semiconductor laser is adjusted while simultaneously emitting laser beams from both the first and second semiconductor lasers. This configuration makes it possible to reduce the number of change-over circuits indispensable for line APC control of semiconductor lasers by one. Thus the maximum voltage stored in the second peak hold circuit is the voltage generated to light the first semiconductor laser and the second semiconductor laser simultaneously. The voltage generated to light the first semiconductor laser and the second semiconductor laser simultaneously is inevitably larger than the voltage generated to light only the semiconductor laser. For this reason, the second peak hold circuit does not require a separate change-over circuit to switch the circuit from the sampling state to hold state since the voltage stored in the second peak hold circuit is not updated when only the first semiconductor lights.

12 Claims, 6 Drawing Sheets

IMAGE FORMING DEVICE HAVING MULTIPLE LASER BEAM SOURCES

BACKGROUND OF THE INVENTION

1. Field of the Invention

The present invention relates to an image forming device that performs optical recording on an image bearing member using a plurality of light sources, and more particularly to an image forming device wherein an automatic power control (APC) is used to adjust the intensity of the light sources.

2. Description of Related Art

In an image forming device, such as a laser printer, optical recording on a photosensitive drum is usually performed by a laser chip including a semiconductor laser serving as a light source, and a photodiode serving as a detector. The optical recording is performed in such a manner that a polygon mirror scans a laser beam modulated by an image signal onto a photosensitive drum. The photodiode detects a part of the laser beam and a detection signal output from the photodiode is fed back to the semiconductor laser to ensure that the intensity of the output from the semiconductor laser is maintained at constant. This type of control is referred to as an APC. APC control is normally performed each time for one line main scan to improve image reliability. This control will hereinafter be referred to as "line APC control".

Japanese Patent Application Publication No. 11-101947 proposes a multi-laser beam printer equipped with a plurality of semiconductor lasers. Such a printer complies with requirements that the laser printers be operated at a high speed and images printed thereby be at high precision. Multi-laser beam printers can form multiple image lines in one scan and print several times faster than a normal print speed without raising the rotational speed of the polygon mirror.

The laser printer disclosed in the Japanese Patent Application Publication performs a line APC control for each semiconductor laser and therefore requires one sample-and-hold capacitor for each semiconductor laser. During sampling, the sample-and-hold capacitors adjust the light amount of the semiconductor laser and maintain the adjusted light amount during the hold state.

However, each sample-and-hold capacitor in a conventional multi-laser beam printer requires a switching circuit to switch the capacitors between a sampling state and a holding state. Thus as many switching circuits as there are semiconductor lasers must be provided, which is costly.

SUMMARY OF THE INVENTION

In view of the foregoing, it is an object of the present invention to provide an image forming device using a multi-laser beam printer with fewer switching circuits than the number of light sources.

In order to attain the above and other objects, the present invention provides an image forming device that includes a first light source, a second light source, a light detecting section, an image bearing member, a scanning unit, a first power control section, a second power control section, and a switching section. The light detecting section detects light emitted from the first light source and the second light source. The image bearing member has an image forming region. The scanning unit scans the light emitted from the first light source and the second light source on the image bearing member. The first power control section is provided in association with the first light source and controls the intensity of light emitted from the first light source based on a first light detection signal output from the light detecting section. The first light detection signal indicates the intensity of light emitted from the first light source. The second power control section is provided in association with the second light source and controls the intensity of light emitted from the second light source based on a second light detection signal output from the light detecting section. The second light detection signal indicates the intensity of light emitted from the first light source and the second light source. The switching section is connected to the first power control section and the second power control section, and disables one of the first power control section and the second power control section while remaining one of the first power control section and the second power control section is enabled.

According to another aspect of the invention, there is provided an image forming device that includes a first light source, a second light source, a third light source, a light detecting section, an image bearing member, a scanning unit, a first power control section, a second power control section, a third power control section, a first switching section, and a second switching section. The light detecting section detects light emitted from the first light source, the second light source, and the third light source. The image bearing member has an image forming region. The scanning unit scans the light emitted from the first light source, the second light source, and the third light source on the image bearing member. The first power control section is provided in association with the first light source and controls the intensity of light emitted from the first light source based on a first light detection signal output from the light detecting section. The first light detection signal indicates the intensity of light emitted from the first light source. The second power control section is provided in association with the second light source and controls the intensity of light emitted from the second light source based on a second light detection signal output from the light detecting section. The second light detection signal indicates the intensity of light emitted from the second light source. The third power control section is provided in association with the third light source and controls the intensity of light emitted from the third light source based on a third light detection signal output from the light detecting section. The third light detection signal indicates the intensity of light emitted from the first light source, the second light source, and the third light source. The first switching section is connected to the first power control section and enables the first power control section. The second switching section is connected to the second power control section and enables the second power control section.

According to still another aspect of the invention, there is provided an image forming device that includes a first light source, a second light source, a light detecting section, an image bearing member, a scanning unit, a first light source control section, a second light source control section, a first signal generating section, a second signal generating section, a third signal generating section, a first control section, a second control section, a third control section, and a fourth control section. The light detecting section detects the light emitted from the first light source and the second light source and outputs a light detection signal having a value that increases as the intensity of light increases. The image bearing member has an image forming region. The scanning unit scans the light emitted from the first light source and the second light source on the image bearing member. The first light source control section controls the intensity of light emitted from the first light source in accordance with a first light detection signal output from the light detecting section. The first light detection signal indicates the intensity of light emitted from the first light source.

The first light source control section includes a first maximum value storing section, a switching section, a first reference value setting section, a first comparator, and a first adjusting section. The first maximum value storing section stores a maximum value of the first light detection signal. The switching section switches the first maximum value storing section to either a sampling state in which the maximum value is updated or a holding state in which the maximum value is maintained. The first-reference value setting section sets a first reference value. The first comparator compares the maximum value stored in the first maximum value storing section with the first reference value and outputs a first comparison result indicating a difference between the first maximum value and the first reference value. The first adjusting section adjusts the intensity of light emitted from the first light source in accordance with the first comparison result.

The second light source control section controls the intensity of light emitted from the second light source in accordance with a second light detection signal output from the light detecting section. The second light detection signal indicates the intensity of light emitted from both the first and second light sources. The second light source control section includes a second maximum value storing section, a second reference value setting section, a second comparator, and a second adjusting section. The second maximum value storing section stores a maximum value of the second light detection signal. The second reference value setting section sets a second reference value. The second comparator compares the maximum value stored in the second maximum value storing section with the second reference value and outputs a second comparison result. The second adjusting section adjusts the intensity of light emitted from the second light source in accordance with the second comparison result.

The first signal generating section generates a first command signal. The first light source emits the light in response to the first command signal. The second signal generating section generates a second command signal. The first and second light sources emit the light in response to the second command signal. The third signal generating section outputs a first switching signal to the switching section. The switching section switches the first maximum value storing section to the sampling state in response to the first switching signal, and outputs a second switching signal to the switching section. The switching section switches the first maximum value storing section to the holding state in response to the second switching signal.

The first control section controls the first signal generating section to output the first command signal. The light emitted from the first light source in response to the first command signal is not irradiated onto the image forming region of the image bearing member. The second control section controls the first and second signal generating sections to simultaneously output the first command signal and the second command signal. The light emitted from the first light source and the second light source in response to the first command signal and the second command signal is not irradiated onto the image forming region of the image bearing member. The third control section controls the third signal generating section to output the first switching signal while only the first signal generating section generates the first command signal. The fourth control section controls the third signal generating section to output the second switching signal while the first signal generating section and the second signal generating section simultaneously generate the first command signal and the second command signal.

According to still another aspect of the invention, there is provided an image forming device that includes a plurality of light sources, a light detecting section, an image bearing member, a scanning unit, a plurality of maximum value storing sections, a plurality of reference value setting sections, a plurality of comparators, a plurality of adjusting sections, a plurality of first signal generating sections, a plurality of switching sections, a plurality of second signal generating sections, a first control section, a second control section, a third control section, and a fourth control section.

The plurality of light sources include a specific light source and other light sources. The light detecting section detects light emitted from the plurality of the light sources and outputs a light detection signal having a value that increases as the intensity of light increases. The image bearing member has an image forming region. The scanning unit scans the light emitted from the plurality of light sources on the image bearing member. The plurality of maximum value storing sections is provided in association with respective ones of the plurality of light sources individually, wherein each maximum value storing section stores a maximum value of the light detection signal indicating the intensity of light emitted only from the associated light source. The plurality of reference value setting sections is provided in association with respective ones of the plurality of light sources individually, wherein each reference value setting section sets a reference value. The plurality of comparators is provided in association with respective ones of the plurality of light sources individually, wherein each comparator compares the maximum value stored in the associated first maximum value storing section with the reference value set in the associated reference value setting section and outputs a comparison result indicating a difference between the maximum value and the reference value. The plurality of adjusting sections is provided in association with respective ones of the plurality of light sources individually, wherein each adjusting section adjusts the intensity of light emitted from the associated light source in accordance with the comparison result output from the associated comparator. The plurality of first signal generating sections is provided in association with respective ones of the plurality of light sources individually, wherein each first signal generating section generates a first command signal. The associated light source emits the light in response to the first command signal. The plurality of switching sections is provided in association with respective ones of said other light sources individually, wherein each switching section switches the associated maximum value storing section to either a sampling state in which the maximum value is updated or a holding state in which the maximum value is maintained. The plurality of second signal generating sections is provided in association with respective one of said other light sources individually, wherein each second signal generating section outputs a first switching signal to the associated switching section. The associated switching section switches the maximum value storing section to the sampling state in response to the first switching signal, and outputs a second switching signal to the associated switching section. The associated switching section switches the maximum value storing section to the holding state in response to the second switching signal.

The first control section controls a plurality of first signal generating sections provided in association with respective ones of said other light sources to output the first command signals according to a time division scheme. The light emitted from said other light sources in response to the first command signals is irradiated onto a portion out of the image forming region of the image bearing member. The second control section controls the plurality of first signal generating sections provided in association with the plurality of light sources including the specific light source and said other light sources to output the first command signals simultaneously. The light emitted from the plurality of light sources including the specific light source and said other light sources in response to the first command signals is irradiated onto a portion out of the image forming region of the image bearing member. The third control section controls the plurality of second signal generating sections so that a plurality of second signal generating sections in association with a plurality of light sources corresponding to the plurality of first signal generating sections generating the first command signals under the control of the first control section outputs the first switching signals while the plurality of first signal generating sections generates the first command signals. The fourth control section controls the plurality of second signal generating sections to generate the second switching signals while the plurality of first signal generating sections generates the first commend signals simultaneously.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
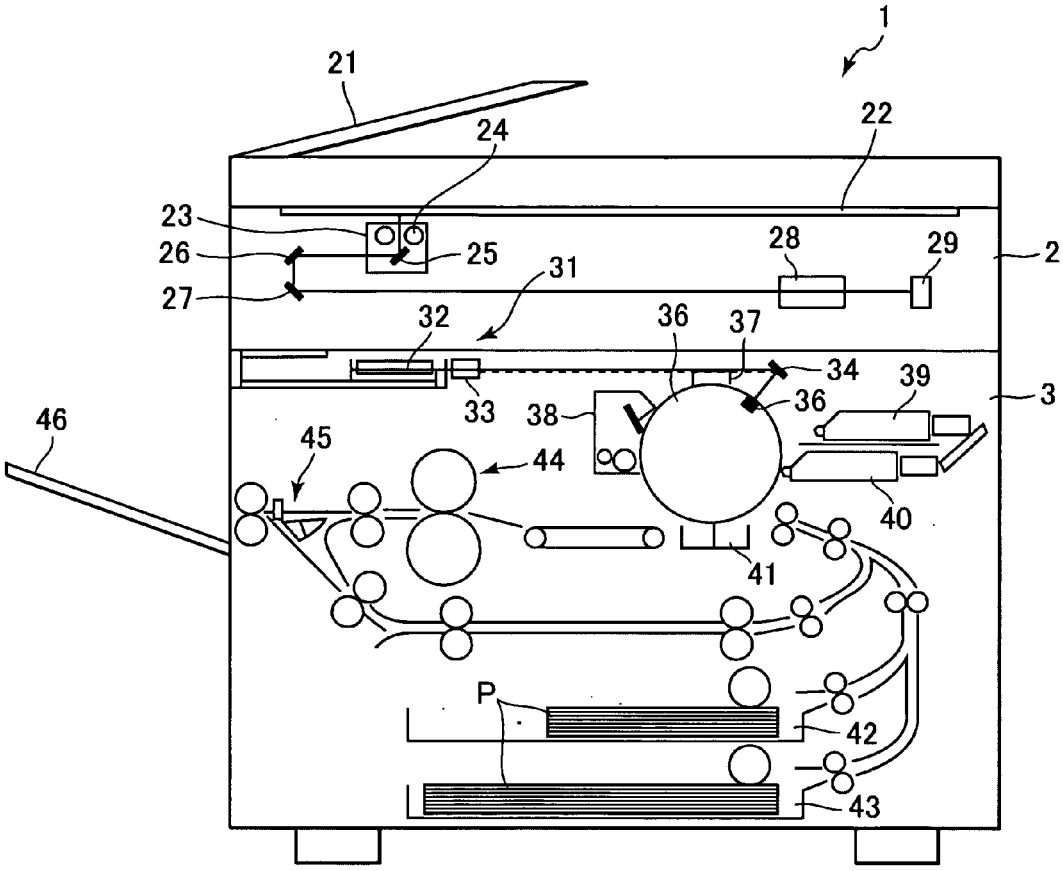
FIG. 1 is a schematic vertical cross-sectional view of an image forming device according to first and second embodiments of the present invention.

An image forming device according to preferred embodiments of the present invention will be described while referring to the accompanying drawings wherein like parts and components are designated by the same reference numerals to avoid duplicating description.

<First Embodiment>

FIG. 1 is a schematic vertical cross-sectional view of an image forming device 1 according to the first embodiment of the present invention.

As shown in FIG. 1, the image forming device 1 according to this embodiment is composed of a scanner section 2 that scans images and a printer section 3 that forms a new image based on the image read by the scanner section 2.

The scanner section 2 has a function that uses data from scanned documents to form dot matrix type image data made up of a plurality main scanning lines. The scanner section 2 is provided with a document feeder 21, a scanner unit 23, a variable power lens 28 and an image sensor 29.

The document feeder 21 allows users to place documents and feed them one-by-one to a copyboard 22.

The scanner unit 23, which includes an elongated lamp 24 and a diagonally placed reflection mirror 25, can be moved freely in the sub-scanning direction (left-to-right direction in the figure). The scanner unit 23 uses lamp 24 to irradiate the document fed to the copyboard 22. The light reflected by the reflection mirror 25 is transferred to the variable power lens 28 by reflection mirrors 26 and 27.

The variable power lens 28 is supported so that the lens can travel freely in beam axis direction allowing light reflected by reflection mirrors 26 and 27 to form an image of a varying magnification in an image sensor 29.

The image sensor 29 is composed of a plurality of CCDs aligned in the main-scanning direction and reads image data on a line-by-line basis from the scanned document. The image data read by the image sensor 29 is processed by the image processor 90 to be described below.

The printer section 3 has an electrophotographic process function for forming images from the dot matrix image data generated by the scanner section 2. To enable image forming using the electrophotographic process, the printer section 3 is provided with a photosensitive drum 36, a beam detect sensor 35 as well as an optical unit 31 that includes a laser drive control section 47 (see FIG. 3), a polygon mirror 32, an f-θ lens 33. The beam detect sensor 35 is referred to as the BD sensor 35 hereinafter.

Figure 2:
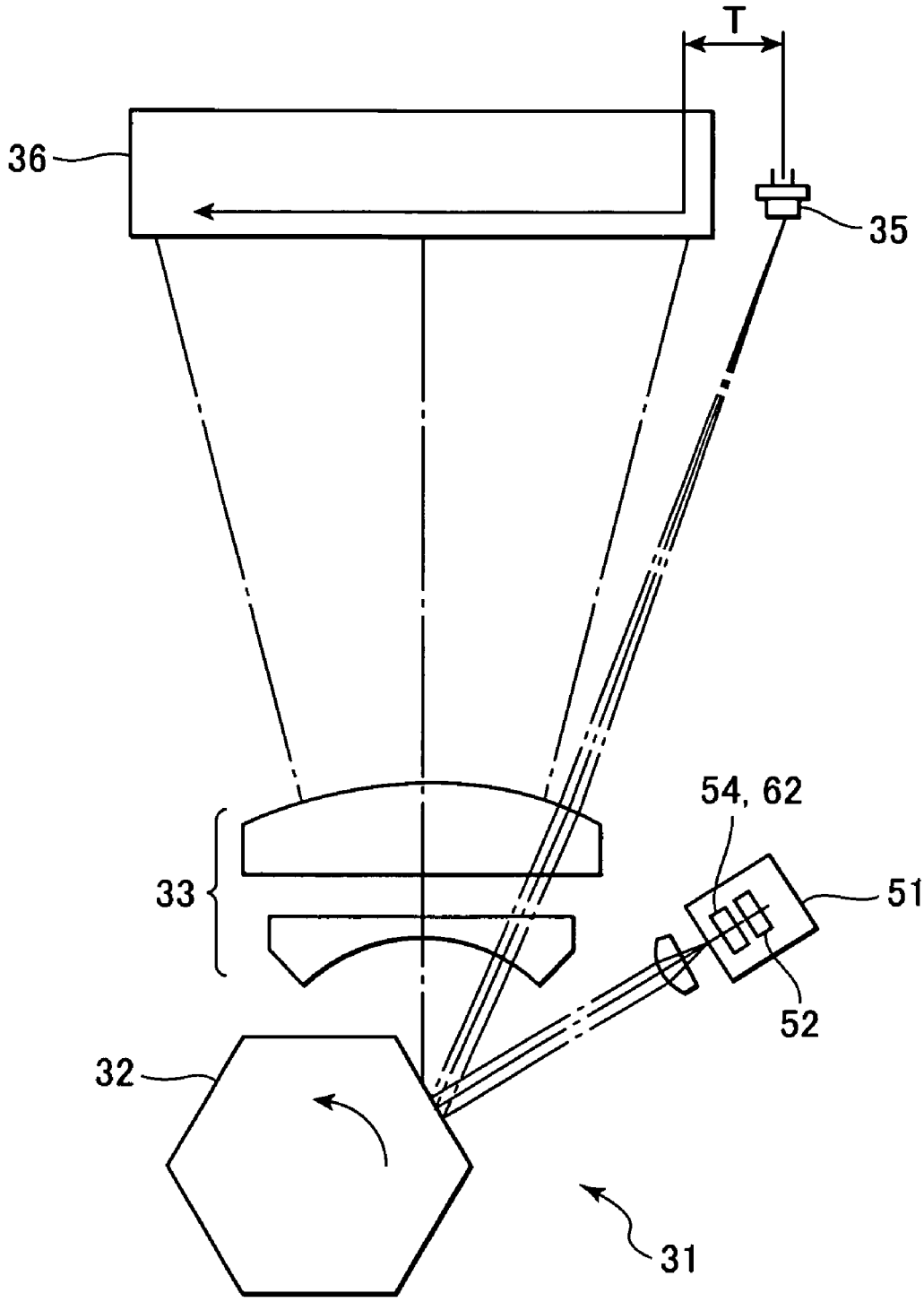
FIG. 2 is a schematic plan view showing the relative locations of a laser chip, optical unit, photosensitive drum and BD sensor according to the first and second embodiments of the present invention.

FIG. 2 is a schematic plan view that shows the relative locations of the optical unit 31, the photosensitive drum or an image bearing member 36, the BD sensor 35 and the laser chip 51 (to be described below) according to the present embodiment.

The laser chip 51 contains two semiconductor lasers 54 and 62, and a laser drive control section 47 (to be described below). The semiconductor lasers 54 and 62 are driven by the image signal. The two laser beams generated by driving the semiconductor lasers 54 and 62 form a latent image on the photosensitive drum 36 by simultaneously performing a linear scan across the photosensitive drum 36. Repeating this process creates a latent image for one page on the photosensitive drum 36.

The polygon mirror 32 is rotatably supported by the scanner motor (not shown). The scanner motor rotates the polygon mirror 32 at a constant angular velocity and the rotation of the mirror deflects the beams of semiconductor lasers 54 and 62 intermittently by changing the beam angle.

The f-θ lens 33 has a function for focusing the laser beam reflected by the polygon mirror 32. The f-θ lens 33 also corrects distortion to ensure correct scanning linearity.

The photosensitive drum 36 is rotatably supported by the drum drive mechanism (not shown) that moves the peripheral surface in the sub-scanning direction relative to the laser beams that scan to expose the peripheral surface. The laser beams form a latent image on the photosensitive drum 36.

The BD sensor 35 is disposed at one side of the scanning range of the polygon mirror 32 where the laser beam is irradiated onto the BD sensor before scanning the photosensitive drum 36 in the main-scanning direction. The BD sensor 35 thus detects the laser beams deflected by the polygon mirror 32 before the beams irradiate the photosensitive drum. The BD sensor 35 detects the laser beams and the photosensitive drum 36 is irradiated a predetermined interval after detection. As a result, the same irradiation starting point can be maintained on the photosensitive drum 36 at all times. The detection signal detected by the BD sensor 35 is processed by the image processor 90 and is used to control the time instant when the semiconductor lasers 54 and 62 irradiate the photosensitive drum 36.

In the printer section 3, the aforementioned optical unit 31, a corona charger 37, developing assemblies 39 and 40, a transfer charger 41 and other-devices are disposed in opposition to the peripheral surface of the photosensitive drum 36. The feed path of paper, the print media, is formed between the transfer charger 41 and the photosensitive drum 36. The paper feed path is formed by a plurality of feed rollers, guide plates and other components extending from paper cassettes 42 and 43 to a discharge tray 46. The paper feed path is provided with a fixing device 44, a paper flip-over mechanism 45 and other components.

In the present embodiment of the image forming device 1 with the configuration described above, the scanner section 2 scans the dot matrix image data from the document as a plurality of main scanning lines. The printer section can print this image data on the recording media using an electrophotographic process.

<Configuration of Laser Drive Control Section>

Figure 3:
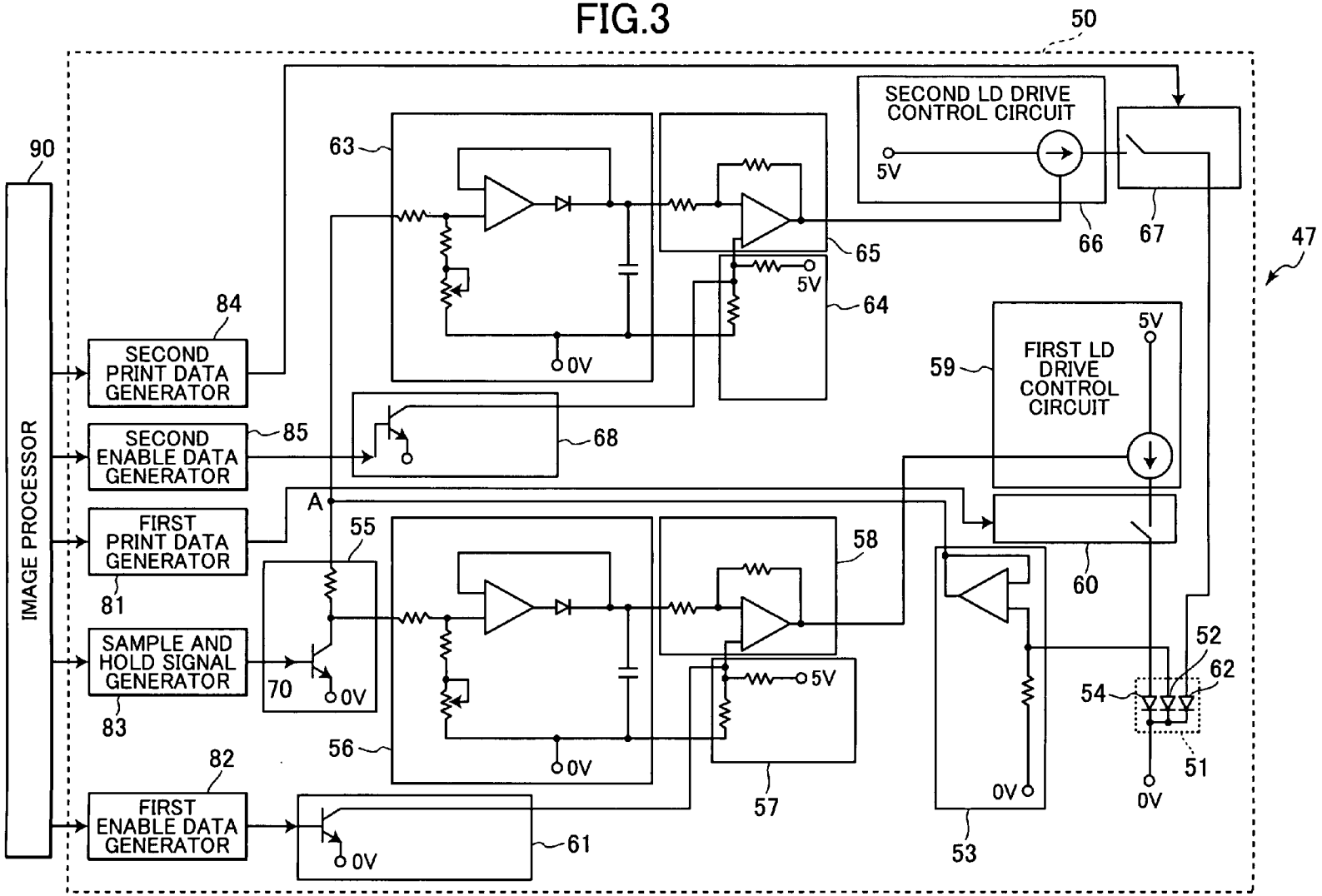
FIG. 3 is a circuit diagram of the LD drive controller according to the first embodiment of the present invention.

In the following, the laser drive control section 47 will be described while referring to FIG. 3. The laser drive control section 47 in the present embodiment is a component of the aforementioned printer section 3. The laser drive control section 47 is composed of the image processor 90, as well as a circuit block 50 that includes the first semiconductor laser 54 and the second semiconductor laser 62.

A circuit block 50 in the present embodiment includes a laser chip 51, a first semiconductor laser control circuit and a second semiconductor laser control circuit.

The first semiconductor laser control circuit is composed of a change-over circuit 55, a first peak hold circuit 56, a first reference voltage generator 57, a first comparator 5B, a first LD drive control circuit 59, a first modulating circuit 60 and a first LD control enable circuit 61. The second semiconductor laser control circuit is composed of a second peak hold circuit 63, a second reference voltage generator 64, a second comparator 65, a second LD drive control circuit 66 and a second modulating circuit 67.

The laser chip 51 contains a first semiconductor laser 54, a second semiconductor laser 62 and a photodiode 52. The first semiconductor laser 54 and the second semiconductor laser 62 have a function for outputting a laser beam. The photodiode 52 detects the laser beams generated by the first semiconductor laser 54 and the second semiconductor laser 62. The photodiode 52 generates a voltage that corresponds to the light amount of the detected laser beam.

The change-over circuit 55 is connected to a voltage amplifier circuit 53 via the photodiode 52. The change-over circuit 55 has a function for switching the first peak hold circuit 56 (to be described below) to the sampling or hold state. The change-over circuit 55 according to the present embodiment is made up of one transistor 70. The sample-and-hold circuit 55 is turned on when the internal transistor 70 is rendered ON.

The input side of the first peak hold circuit 56 is connected to the change-over circuit 55. The first peak hold circuit 56 has a function for storing the maximum voltage output from the photodiode 52. The first peak hold circuit 56 according to the present embodiment is composed of variable resistors, operational amplifiers, diodes and capacitors. The voltages output from the photodiode 52 are sequentially input to a capacitor, which always stores the maximum input voltage. More specifically, when the change-over circuit 55 is off, the first peak hold circuit 56 is in the sampling state and the maximum voltage stored in the capacitor is updatable, and when the change-over circuit 55 is on, the input voltage to the first peak hold circuit 56 is at the ground level of 0 V. Then the first peak hold circuit 56 is in the hold state and the stored maximum voltage in the capacitor is held and cannot be updated.

The first reference voltage generator 57 has a function that generates the preset first reference voltage. The first reference voltage is set when the image forming device 1 is manufactured and cannot be changed by the user. The first reference voltage is set so that the first semiconductor laser 54 will output the optimum light amount needed for printing. More specifically, in the final manufacturing stage after the image forming device 1 has been assembled, the first reference voltage is adjusted to the value that will enable the first semiconductor laser 54 to output the optimum light amount needed for printing.

The first LD control enable circuit 61 is connected to the first reference voltage generator 57. The first LD control enable circuit 61 has a function that switches the first reference voltage output from the first reference voltage generator 57 that the first comparator 58 is either supplied or not supplied with this voltage. The first LD control enable circuit 61 is composed of one transistor. The first reference voltage generator 57 supplies the first comparator 58 with the first reference voltage when the transistor in first LD control enable circuit 61 is off, The first LD control enable circuit 61 goes on when the internal transistor is rendered ON.

The input of the first comparator 58 is connected to the first peak hold circuit 56 and the first reference voltage generator 57. The first comparator 58 compares the maximum voltage stored in the first peak hold circuit 56 with the first reference voltage output from the first reference voltage generator 57 and has a function for outputting a voltage that corresponds to this difference.

The first LD drive control circuit 59 is connected to the first comparator 58. The first LD drive control circuit 59 has a function that controls the current supplied to the first semiconductor laser 54 depending on the voltage output from the first comparator 58.

The input of the first modulating circuit 60 is connected to the first LD drive control circuit 59, and the output is connected to the first semiconductor laser 54. The first modulating circuit 60 has a switch that goes on and off depending on signals output from the first print data generator 81, described below. When the switch is on, the current output from the first LD drive control circuit 59 is supplied to the first semiconductor 54. The first modulating circuit 60 goes on when the internal switch is on.

The input of the second peak hold circuit 63 branches from the midpoint A of the connection between the voltage amplifier 53 and the change-over circuit 55 and is connected to the output of the photodiode 52. The second peak hold circuit 63 has a function for storing the maximum voltage output from the photodiode 52. Like the first peak hold circuit 56, the second peak hold circuit 63 is composed of variable resistors, operational amplifiers, diodes and capacitors. The voltages output from the photodiode 52 are sequentially input to a capacitor, which always stores the maximum input voltage. The voltage stored in the capacitor in the second peak hold circuit 63 is always updatable regardless of the on/off state of the change-over circuit 55 in the sample-and-hold circuit 77.

The second reference voltage generator 64 has a function that outputs the preset second reference voltage. In the present embodiment, the second reference voltage is set to a value higher than the first reference voltage 1 that is set by the first reference voltage generator 57. Like the first reference voltage, the second reference voltage is set when the image forming device 1 is manufactured and cannot be changed by the user. The second reference voltage is set so that the second semiconductor laser 62 will output the optimum light amount needed for printing. More specifically, in the final manufacturing stage after the image forming device 1 has been assembled, the second reference voltage is adjusted to the value that will enable the second semiconductor laser 62 to output the optimum light amount needed for printing. The second reference voltage is adjusted so that the first semiconductor laser 54 and the second semiconductor laser 62 go on simultaneously. As described below, the light amount of the second semiconductor laser 62 is controlled by line APC so that the first semiconductor laser 54 and the second semiconductor laser 62 light simultaneously.

The second LD control enable circuit 68 is connected to the second reference voltage generator 64. The second LD control enable circuit 68 has a function that provides the second reference voltage output from the second reference voltage generator 64 to the second comparator 65. The second LD control enable circuit 68 is composed of one transistor. The second reference voltage generator 64 supplies the second comparator 65 with the second reference voltage when the transistor in the second LD control enable circuit 68 is off. The second LD control enable circuit 68 goes on when the internal transistor is rendered ON.

The input of the second comparator 65 is connected to the outputs of the second peak hold circuit 63 and the second reference voltage generator 64. The second comparator 65 compares the maximum value stored in the second peak hold circuit 63 with the second reference voltage output from the second reference voltage generator 64 and has a function for outputting a voltage that corresponds to this difference.

The second LD drive control circuit 66 is connected to the second comparator 65. The second LD drive control circuit 66 has a function that controls the voltage that is supplied to the second semiconductor laser 62 depending on the voltage output from the second comparator 65.

The input of the second modulating circuit 67 is connected to the second LD drive control circuit 66, and the output is connected to the second semiconductor laser 62. The second modulating circuit 67 has a switch that goes on and off depending on signals output from the second print data generator 84. When the switch is on, the current output from the second LD drive control circuit 66 is supplied to the second semiconductor 62. The second modulating circuit 67 goes on when the internal switch is on.

A connecting circuit is formed in the circuit block 50 by a connecting wire from the photodiode 52 to the midpoint A, a connecting wire extending from the midpoint A to the first peak hold circuit 56 via the change-over circuit 55 and a connecting wire extending from the midpoint A to the second peak hold circuit 63. A detector is formed from this connecting circuit and the photodiode 52.

The circuit block 50 also has a first print data generator 81, a first enable data generator 82, a sample-and-hold signal generator 83, a second print data generator 84 and a second enable signal generator 85.

The first print data generator 81 outputs a signal that causes the first semiconductor laser 54 to output a laser beam. More specifically, when the first print data generator 81 outputs a low-level signal, the first modulating circuit 60 goes on. Then the first semiconductor laser 54 outputs a laser beam.

The first enable signal generator 82 outputs a signal to the first LD control enable circuit 61 to supply the first comparator 58 with the first reference voltage output from the first reference voltage generator 57. More specifically, the first enable signal generator 82 outputs a low-level signal that turns off the first LD control enable circuit 61. Then the first reference voltage generator 57 supplies the first reference voltage to the first comparator 58.

The second print data generator 84 outputs a signal that causes the second semiconductor laser 62 to output a laser beam. More specifically, when the second print data generator 84 outputs a low-level signal, the second modulating circuit 67 goes on. Then the second semiconductor laser 62 outputs a laser bear.

The second enable signal generator 65 outputs a signal to the second LD control enable circuit 68 to supply the second comparator 65 with the second reference voltage output from the second reference voltage generator 64, described below. More specifically, the second enable signal generator 84 outputs a low-level signal that turns off the second LD control enable circuit 68. Then the second reference voltage generator 64 supplies the second reference voltage to the second comparator 64.

The sample-and-hold signal generator 83 outputs a signal to control the change-over circuit 55 and switch the first peak hold circuit 56 to the sampling or hold state. More specifically, when the change-over signal generator 83 outputs a low-level signal, the change-over circuit 55 is turned off and the first peak-and-hold circuit 56 is set to the sampling state. The sample-and-hold signal generator 83 outputs a high-level signal to turn on the change-over circuit 55 and sets the first peak hold circuit 56 to the hold state.

The image forming device 1 is provided with a CPU (not shown) that performs integrated control of device components and ROM (not shown) that stores programs executed by the CPU. In the present embodiment, the image processor 90 is formed by the CPU executing some of the programs in ROM. More specifically, the image processor 90 has a function for processing image signals scanned by an image sensor 29 and controlling circuit block 50.

The image processor 90 consists of the first control section, the second control section, the third control section, the fourth control section, the first enable signal generator controller and the second enable generator controller.

The first control section controls only the first print data generator 81 of the first print data generator 81 and the second print data generator 84 to output a low-level signal in the non-image area of the photosensitive drum 36.

The second control section has a function that simultaneously outputs a low level signal in the non-image area on the photosensitive drum 36 from the first print data generator 81 and the second print data generator 94.

The third control section controls the sample-and-hold signal generator 83 to output a low-level signal while the aforementioned first control section outputs a low-level signal only from the first print data generator 81.

The fourth control section controls the sample-and-hold signal generator 83 to output a high-level signal while the aforementioned second control section simultaneously outputs a low-level signal from the first print data controller 81 and the second print data controller 84.

The first enable signal generator controller controls the first enable signal generator 82 to output a low-level signal during printing. The second enable signal generator controller controls the second enable signal generator 85 to output a low-level signal during printing.

When the first enable signal generator 82 and the second enable signal generator 85 output a low-level signal, the first LD control enable circuit 61 and the second LD control enable circuit 68 are turned off. When the first LD control enable circuit 61 and the second LD control enable circuit 68 are turned off, the first reference voltage generator 57 supplies the first comparator 58 with the first reference voltage and the second reference voltage generator 64 supplies the second comparator 65 with the second reference voltage.

<Line APC Control>

In the following, the flow of line APC control in the present embodiment will be described while referring to the timing chart in FIG. 4. Line APC control is to adjust the light amount or light intensity of the first semiconductor laser 54 and the second semiconductor laser 62 each time when one line scanning is performed main scanning cycle. Line APC in the present embodiment is performed for each main scanning cycle prior to laser irradiation of the photosensitive drum 36.

First, the first control section and the third control section output a low-level signal in the non-image area of the photosensitive drum 36 in the time instant t1 to t2 from the first print data generator 81 and the sample-and-hold signal generator 83 in the circuit block 50. When the first print data generator 81 outputs a low-level signal, the first modulating circuit 60 goes on and the first semiconductor laser 54 outputs a laser beam. The photodiode 52 receives the laser beam output from the first semiconductor laser 54 and outputs a voltage. When the sample-and-hold signal generator 83 outputs a low-level signal, the change-over circuit 55 goes off and the first peak hold circuit 56 enters the sampling state. In this state, the voltage output from the photodiode 52 is sequentially stored in the first peak hold circuit 56 and the stored maximum value is updated. The first comparator 58 compares the updated maximum value with the first reference voltage provided by the first reference voltage generator 57 and outputs the voltage difference to the first LD drive control circuit 59. The first LD drive control circuit 59 references the voltage difference output from the first comparator 58 and adjusts the current supplied to the first semiconductor laser 54. The light amount of the laser beam output from the first semiconductor laser 54 is thus adjusted to the optimum intensity for printing.

Then the second control section and the fourth control section simultaneously output a low-level signal in the non-image area of the photosensitive drum 36 in the time instant t3 to t4 from the first print data generator 81 and the second print data generator 84 in the circuit block 50 and output a high-level signal from the sample-and-hold signal generator 83. When the first print data generator 81 outputs a low-level signal, the first modulating circuit 60 goes on and the first semiconductor laser 54 outputs a laser beam. When the second print data generator 84 outputs a low-level signal, the second modulating circuit 67 goes on and the second semiconductor laser 62 outputs a laser beam. Since both the first semiconductor laser 54 and the second semiconductor laser 62 output laser beams simultaneously, the photodiode 52 receives a greater amount of light than when only the first semiconductor laser 54 outputs a beam. Accordingly the photodiode outputs a higher voltage. The maximum value stored in the second peak hold circuit 63 is updated by this large voltage. The second comparator 65 compares the updated maximum value with the second reference voltage output from the second reference voltage generator 64 and outputs a voltage that corresponds to the difference between the two values. The second LD drive control circuit 66 references the voltage output from the second comparator 65 and adjusts the current supplied to the second semiconductor laser 62. Then since the change-over circuit 55 is turned on by the high-level signal output from the sample-and-hold signal generator 83, the maximum value stored in the first peak hold circuit 56 is not affected even when the first semiconductor laser 54 and the second semiconductor laser 62 output laser beams simultaneously. The light amount of the laser beam output from the second semiconductor laser 62 is thus adjusted to the optimum amount required for printing.

Figure 4:
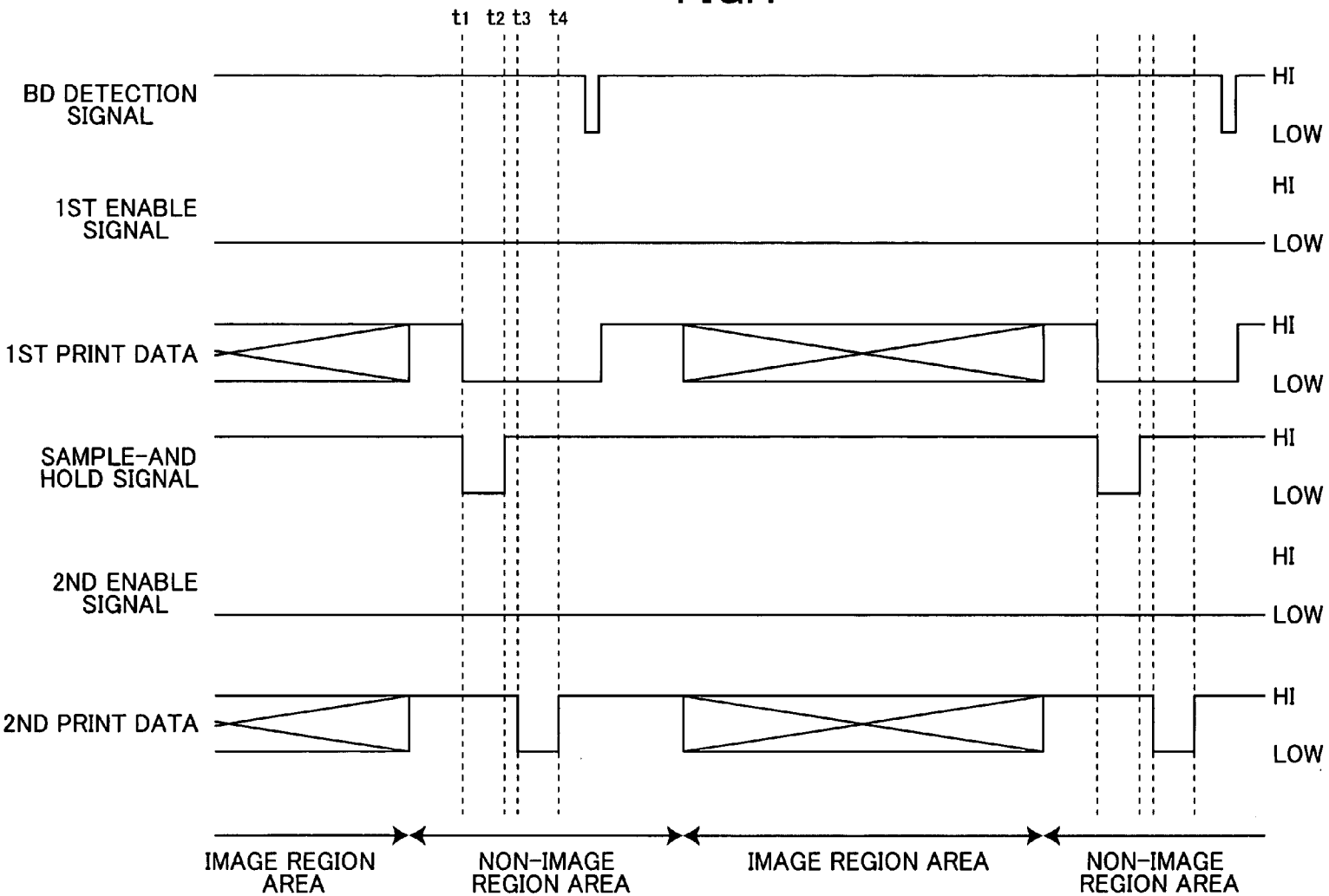
FIG. 4 is a timing chart showing line APC flow according to the first embodiment of the present invention.

The time interval between time instant t2 to t3 in FIG. 4 is provided to prevent the laser beam of the second semiconductor laser 62 from blending with the laser beam of first semiconductor laser 54 when the first peak hold circuit 56 is in the sampling state causing the first light amount control to malfunction.

As described above, in this embodiment of the present invention, the light amount of the second semiconductor laser 62 is adjusted so that the first semiconductor laser 54 and the second semiconductor laser 62 go on simultaneously. This type of configuration makes it possible to reduce the number of change-over circuits that are indispensable to line APC control of semiconductor lasers 54 and 62 by one. Thus the maximum voltage value stored by the second peak hold circuit 63 is the voltage generated when both the first semiconductor laser 54 and the second semiconductor laser 62 go on simultaneously. The voltage generated when both the first semiconductor laser 54 and the second semiconductor laser 62 go on simultaneously is inevitably larger than the voltage generated by the first semiconductor laser 54 alone. As a result, there is no need to provide a separate change-over circuit for switching the second peak hold circuit 63 between sampling and hold states since the voltage stored in the second peak hold circuit 63 is not updated when only the first semiconductor laser 54 goes on.

As soon as the light amount of the laser beams output from the first semiconductor laser 54 and the second semiconductor laser 62 is line APC controlled, the laser beam deflected from the first semiconductor laser 54 is detected by the BD sensor 35. A predetermined time period T after the BD sensor 35 detects the beam, the image processor 90 turns the first modulating circuit 60 and the second modulating circuit 67 on and off according to the image data scanned by the image sensor 29. As a result, the first LD drive control circuit 59 and the second LD drive control circuit 66 provide the first semiconductor laser 54 and the second semiconductor laser 62 with an appropriate amount of current to obtain the desired print result.

<Second Embodiment>

The following will describe the second embodiment of the present invention. The second embodiment of the image forming device 101 differs from the first embodiment only in the configuration of the laser drive control section 147. For this reason, only the configuration and function of the laser drive control section 147 in the second embodiment of the image forming device 101 will be described.

<Configuration of Laser Drive Control Section>

Figure 5:
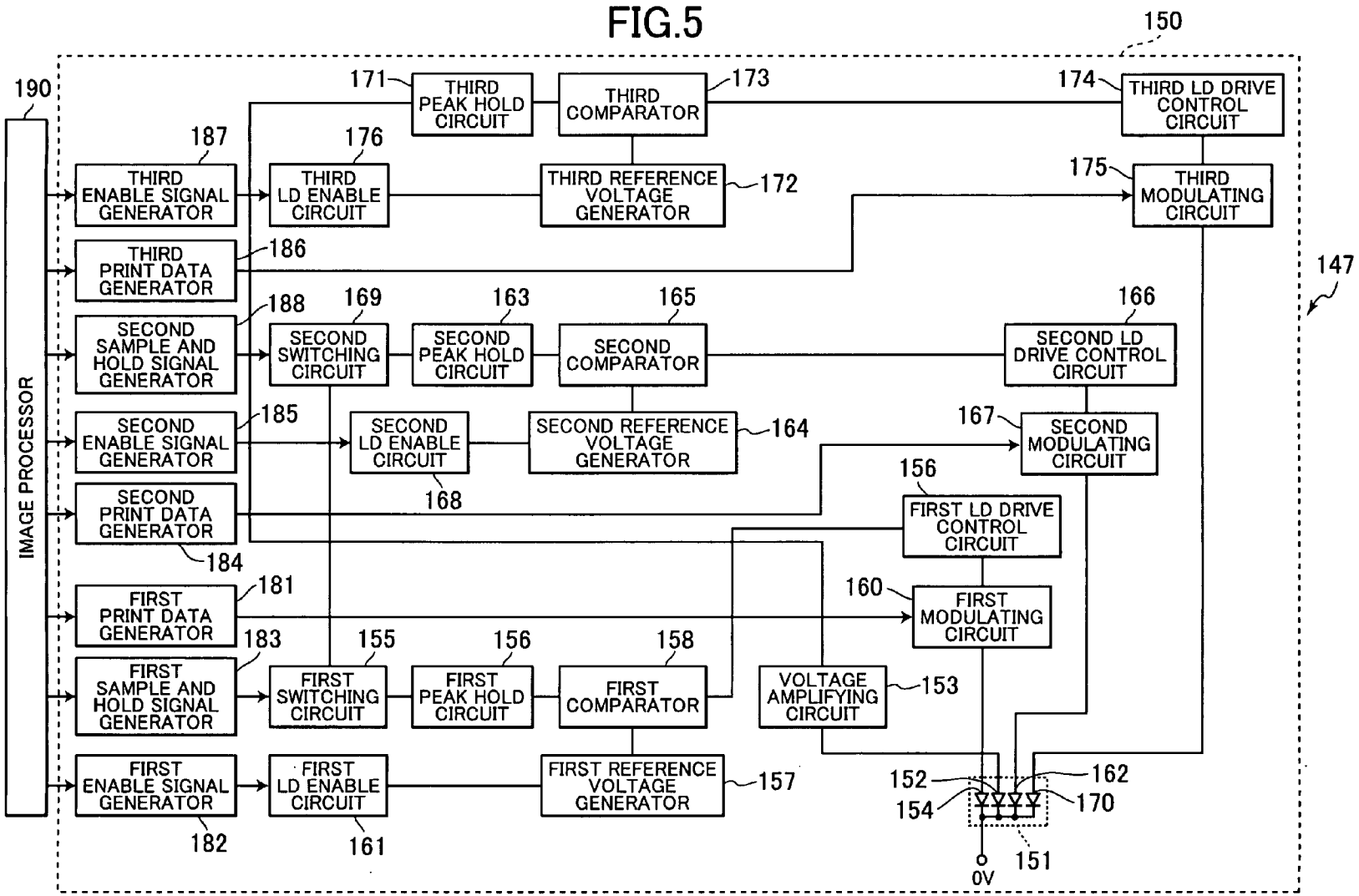
FIG. 5 is an explanatory diagram of the LD drive controller according to the second embodiment of the present invention.

FIG. 5 is an explanatory diagram showing the configuration of the laser drive control section 147 in the second embodiment of the image forming device 101. The components (transistors, capacitors, operational amplifiers, etc.) in this configuration shown in FIG. 5 are the same as those of the first embodiment shown in FIG. 3.

The laser drive control section 147 is composed of an image processor 190 and a circuit block 150 with semiconductor lasers.

The circuit block 150 in the present embodiment have in addition to the components in the first embodiment, a second change-over circuit 169, a third peak hold circuit 171, a third reference voltage generator 172, a third comparator 173, a third LD drive control circuit 174, a third modulating circuit 175 and a third LD enable circuit 176. A laser chip 151 contains a third semiconductor laser 170.

Like the first semiconductor laser 154 and the second semiconductor laser 162, the third semiconductor laser 170 has a function for outputting a laser beam when provided with a drive current. A photodiode 152 detects the laser beams output from the first semiconductor laser 154, the second semiconductor laser 162 and the third semiconductor laser 170. The photodiode 152 generates a voltage that corresponds to the light amount of the detected laser beam.

The second change-over circuit 169 branches off from a connection B of the voltage amplifier 153 and the first change-over circuit 155. The output of the change-over circuit is connected to the second peak hold circuit 163. Like the first change-over circuit 155, the second change-over circuit 169 has a function that switches the second peak hold circuit 163 between the sampling and hold states.

The third peak hold circuit 171 branches from the aforementioned connection B. The input of the peak hold circuit is connected to the output of the photodiode 152. The third peak hold circuit 171 has a function for storing the maximum value of the signal output from the photodiode 152. Like the first peak hold circuit 156 and the second peak hold circuit 163, the third peak hold circuit 171 is composed of variable resistors, operational amplifiers, diodes and capacitors. The voltages output from the photodiode 152 are sequentially input to a capacitor, which always stores the maximum input voltage. The voltage stored in the capacitor in the third peak hold circuit 171 is always updatable regardless of the on/off state of the first change-over circuit 155 and the second change-over circuit 169.

The third reference voltage generator 172 has a function that outputs the preset third reference voltage. The third reference voltage is set to a higher value than the first reference voltage set by the first reference voltage generator 157 and the second reference voltage set by the second reference voltage generator 164. The third reference voltage is set when the image forming device 101 is manufactured and cannot be changed by the user. The third reference voltage is set so that the third semiconductor laser 170 will output the optimum light amount needed for printing. In the final manufacturing stage after the image forming device 101 has been assembled, the third reference voltage is adjusted to the value that will enable the third semiconductor laser 170 to output the optimum light amount needed for printing. The third reference voltage is adjusted so that the first semiconductor laser 154, the second semiconductor laser 162 and the third semiconductor laser 170 light simultaneously.

The third LD control enable circuit 176 is connected to the third reference voltage generator 172. The third LD control enable circuit 176 has a switching function so that the third comparator 173 described below is either supplied or not supplied with the third reference voltage output from the third reference voltage generator 172. The third LD control enable circuit 176 is composed of one transistor. The third reference voltage generator 172 supplies the third comparator 173 with the third reference voltage when the transistor in the third LD control enable circuit 176 is off. The third LD control enable circuit 61 goes on when the internal transistor goes on.

The input of the third comparator 173 is connected to the outputs of the third peak hold circuit 171 and the third reference voltage generator 172. The third comparator 173 compares the maximum value stored in the third peak hold circuit 171 with the third reference voltage generated by the third reference voltage generator 172 and has a function for outputting a voltage that corresponds to this difference.

The third LD drive control circuit 174 is connected to the third comparator 173. The third LD drive control circuit 174 has a function that adjusts the current that is supplied to the third semiconductor laser 170 depending on the voltage output from the third comparator 173.

The input of the third modulating circuit 175 is connected to the third LD drive control circuit 174, and the output is connected to the third semiconductor laser 170. The third modulating circuit 175 has a switch that goes on and off depending on signals output from the third print data generator 186, described below. When the switch is on, the current output from the third LD drive control circuit 174 is supplied to the third semiconductor 170. The third modulating circuit 175 goes on when the internal switch is on.

The circuit block 150 is also provided with a second change-over signal generator 188, a third print data generator 186 and a third enable signal generator 187.

The second change-over signal generator 188 controls the aforementioned second change-over circuit 169 and outputs a signal that switches the peak hold circuit 163 either to the sampling or hold state. More specifically, the second sample-and-hold signal generator 188 outputs a low-level signal that turns off the second change-over circuit 169 and sets the second peak hold circuit 163 to the sampling state. The second change-over signal generator 188 outputs a high-level signal that turns on the second change-over circuit 169 and sets the second peak hold circuit 163 to the hold state.

The third print data generator 166 outputs a signal that causes the third semiconductor laser 170 to output a laser beam. More specifically, when the third print data generator 186 outputs a low-level signal, the third modulating circuit 175 goes on. Then the third semiconductor laser 170 outputs a laser beam.

The third enable signal generator 187 outputs a signal to supply the third comparator 173 with the third reference voltage output from the third reference voltage generator 172. More specifically, the third enable signal generator 187 outputs a low-level signal that turns off the third LD control enable circuit 176. Then the third reference voltage generator 172 supplies the third reference voltage to the third comparator 173.

The image processor 190 consists of the first control section, the second control section, the third control section, the fourth control section, the first enable signal generator controller, the second enable signal generator controller and the third enable signal generator controller. The first control section, the second control section, the third control section and the fourth control section in this embodiment have functions that differ from that of the first embodiment.

The first control section controls the first print data generator 181 and the second print data generator 184 to output a low-level signal according to a time-division scheme in the non-image area of the photosensitive drum 136.

The second control section controls the first print data generator 181, the second print data generator 184 and the third print data generator 186 to simultaneously output a low-level signal in the non-image area of the photosensitive drum 136.

The third control section controls only the first sample-and-hold signal generator 183 to output a low-level signal while the aforementioned first control section outputs a low-level signal from the first print data generator 181. The third control section also controls only the second sample-and-hold signal generator 188 to output a low-level signal while the second print data generator 184 outputs a low-level signal.

The fourth control section controls the first sample-and-hold signal generator 183 and the second sample-and-hold signal generator 188 to output a high-level signal while the aforementioned second control section outputs a low-level signal simultaneously from the first print data generator 181, the second print data generator 184 and the third print data generator 186.

The first enable signal generator controller controls the first enable signal generator 182 to output a low-level signal during printing. The second enable signal generator controller controls the second enable signal generator 185 to output a low-level signal during printing. The third enable signal generator controller controls the third enable signal generator 187 to output of a low-level signal during printing.

<Line APC Control>

Figure 6:
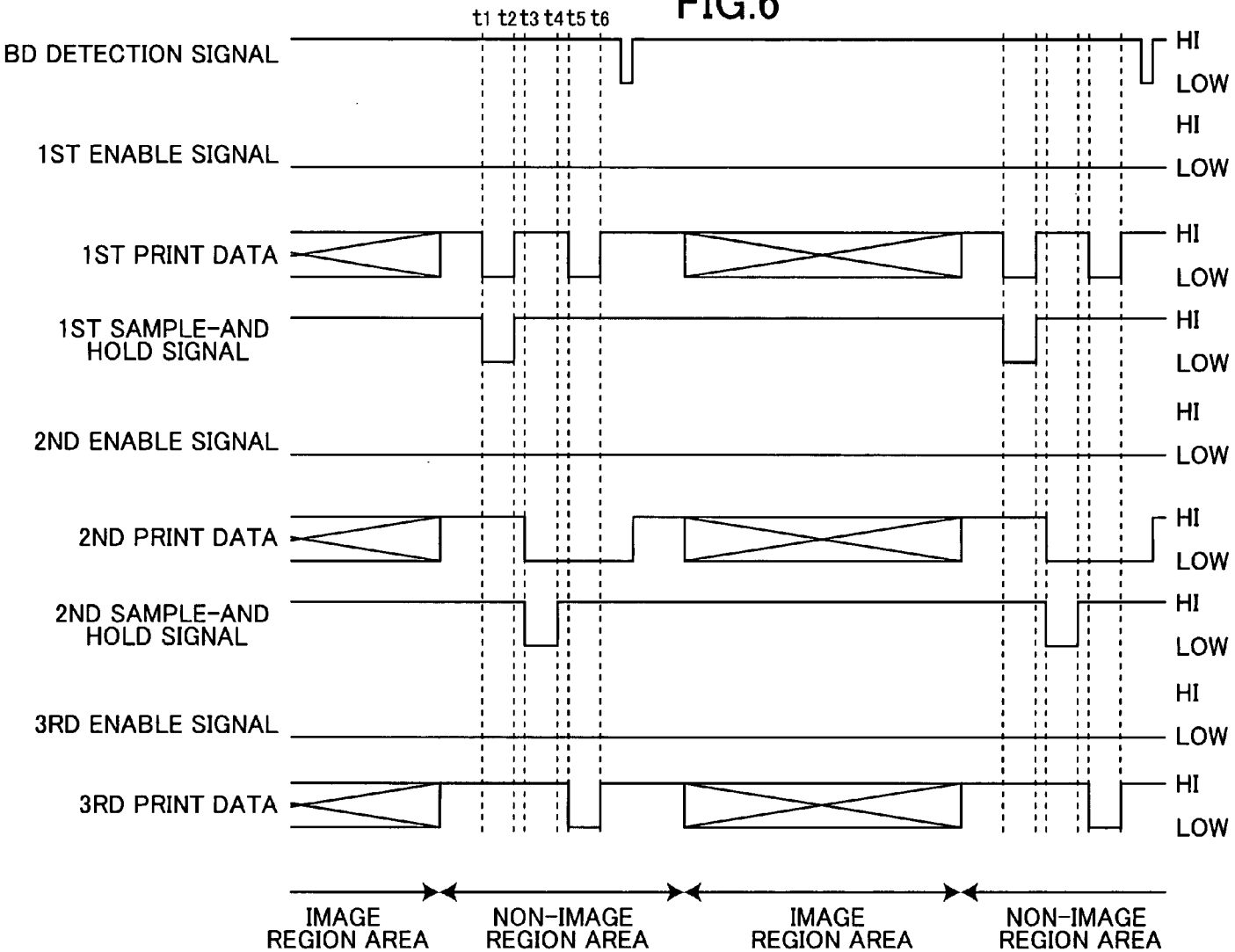
FIG. 6 is a timing chart showing line APC flow according to the second embodiment of the present invention.

In the following, the flow of line APC control in the present embodiment will be described while referring to the timing chart in FIG. 6. Line APC control is designed to adjust the light amount of the first semiconductor laser 154, the second semiconductor laser 162 and the third semiconductor laser 170 each main scanning cycle.

First, the first control section and the third control section output a low-level signal in the non-image area of the photosensitive drum 136 in the time instant t1 to t2 from the first print data generator 181 and the first sample-and-hold signal generator 183 in the circuit block 150. When the first print data generator 181 outputs a low-level signal, the first modulating circuit 160 goes on and the first semiconductor laser 154 outputs a laser beam. The photodiode 152 receives the laser beam output from the first semiconductor laser 154 and outputs a voltage. When the first sample-and-hold signal generator 183 outputs a low-level signal, the first change-over circuit 155 goes off and the first peak hold circuit 156 enters the sampling state. In this state, the voltage output from the photodiode 152 is sequentially stored in the first peak hold circuit 156 and the stored maximum value is updated. The first comparator 158 compares the updated maximum value with the first reference voltage provided by the first reference voltage generator 157 and outputs the voltage difference to the first LD drive control circuit 159. The first LD drive control circuit 159 references the voltage difference output from the first comparator 158 and adjusts the current supplied to the first semiconductor laser 154. The light amount of the laser beam output from the first semiconductor laser 154 is thus adjusted to the optimum intensity required for printing.

The second sample-and-hold signal generator 198 is controlled to output a high-level signal in this situation. Thus the second peak hold circuit 163 is maintained in the hold state and the maximum voltage stored in the second peak hold circuit 163 is not updated by the voltage output from the laser beam from the second semiconductor laser 154.

Then, the first control section and the third control section output a low-level signal in the non-image area of the photosensitive drum 136 in the time instant t3 to t4 from the second print data generator 184 and the second sample-and-hold signal generator 188 in the circuit block 150. When the second print data generator 184 outputs a low-level signal, the second modulating circuit 167 goes on and the second semiconductor laser 162 outputs a laser beam. The photodiode 152 receives the laser beam output from the second semiconductor laser 162 and outputs a voltage. When the second change-over signal generator 185 outputs a low-level signal, the second change-over circuit 169 goes off and the second peak hold circuit 163 enters the sampling state. In this state, the voltage output from the photodiode 152 is sequentially stored in the second peak hold circuit 163 and the maximum value is updated. The second comparator 165 compares the updated maximum value with the second reference voltage provided by the second reference voltage generator 164 and outputs the voltage difference to the second LD drive control circuit 166. The second LD drive control circuit 166 references the voltage difference output from the second comparator 165 and adjusts the current supplied to the second semiconductor laser 162. The light amount of the laser beam output from the second semiconductor laser 162 is thus adjusted to the optimum intensity for printing.

The first sample-and-hold signal generator 183 is controlled to output a high-level signal in this situation. Thus the first peak hold circuit 156 is maintained in the hold state and the maximum voltage stored in the first peak hold circuit 156 is not updated by the voltage output from the laser beam from the first semiconductor laser 162.

Then the second control section and the fourth control section simultaneously output a low-level signal in the non-image area of the photosensitive drum 136 in the time instant t5 to t6 from the first print data generator 181, the second print data generator 184 and the third print data generator 186 in the circuit block 150 and output a high-level signal to the first sample-and-hold signal generator 183 and the second sample-and-hold signal generator 188. When the first print data generator 181 outputs a low-level signal, the first modulating circuit 160 goes on and the first semiconductor laser 154 outputs a laser beam. When the second print data generator 184 outputs a low-level signal, the second modulating circuit 167 goes on and the second semiconductor laser 162 outputs a laser beam. When the third print data generator 186 outputs a low-level signal, the third modulating circuit 175 goes on and the third semiconductor laser 170 outputs a laser beam.

Since the first semiconductor laser 154, the second semiconductor laser 162 and the third semiconductor laser 170 output a laser beam simultaneously, the photodiode 152 outputs a larger voltage than when the first semiconductor laser 154 or the second semiconductor laser 162 outputs a laser beam. The maximum value stored in the third peak hold circuit 171 is updated by this large voltage. The third comparator 173 compares the updated maximum value with the third reference voltage output from the third reference voltage generator 172 and outputs a voltage that corresponds to the difference between the two values. The third LD drive control circuit 174 references the voltage output from the third comparator 173 and adjusts the current supplied to the third semiconductor laser 170. In this case, the first change-over circuit 155 and the second change-over circuit 169 are turned on by the high-level signals output from the first sample-and-hold signal generator 183 and the second sample-and-hold signal generator 188, respectively. As a result, even when the first semiconductor laser 154, the second semiconductor laser 162 and the third semiconductor laser 170 output laser beams simultaneously, the maximum value stored in the first peak hold circuit 156 and the second peak hold circuit 163 are not affected. The light amount of the laser beam output from the third semiconductor laser 170 is thus adjusted to the optimum intensity for printing.

As described above, in this embodiment of the present invention, the light amount of the third semiconductor laser 170 is adjusted such that the first semiconductor laser 154, the second semiconductor laser 162 and the third semiconductor laser 170 go on simultaneously. This type of configuration makes it possible to reduce the number of change-over circuits that are indispensable to line APC control of semiconductor lasers 154, 162 and 170 by one. Thus the maximum voltage value stored by the third peak hold circuit 171 is the voltage generated when the first semiconductor laser 154, the second semiconductor laser 162 and the third semiconductor laser 170 go on simultaneously. The voltage generated when the first semiconductor laser 154, the second semiconductor laser 162 and the third semiconductor laser 170 go on simultaneously is inevitably greater than the voltage output when only the first semiconductor laser 154 or the second semiconductor laser go on. For this reason, even if the third peak hold circuit 171 is not provided with a change-over circuit, the voltage stored in the peak hold circuit 171 is not updated when the first semiconductor laser 154 or the second semiconductor laser 162 go on.

As soon as the light amount of the laser beams output from the first semiconductor laser 154, the second semiconductor laser 162 and the third semiconductor laser 170 is line APC controlled, the laser beam deflected from the second semiconductor laser 162 is detected by the BD sensor 135. A predetermined time period T after the BD sensor 135 detects the beam, the image processor 190 turns the first modulating circuit 160, the second modulating circuit 167 and the third modulating circuit 175 on and off according to the image data scanned by the image sensor 129. As a result, the first LD drive control circuit 159, the second LD drive control circuit 166 and the third LD drive control circuit 174 provide the first semiconductor laser 154, the second semiconductor laser 162, and the third semiconductor laser 170 with an appropriate amount of drive current to obtain the desired print result.

While the invention has been described in detail with reference to the specific embodiment thereof, it would be apparent to those skilled in the art that various changes and modifications may be made therein without departing from the spirit and scope of the invention.

For example, in the above-described embodiments, the number of semiconductor lasers could be increased to four, five or six. In any case, if the number of semiconductor lasers is "n", the number of change-over circuits would be "n−1".

What is claimed is:

1. An image forming device comprising:

a first light source emitting light with an intensity;

a second light source emitting light with an intensity;

a light detecting section that detects light emitted from the first light source and the second light source;

an image bearing member having an image forming region;

a scanning unit that scans the light emitted from the first light source and the second light source on the image bearing member;

a first power control section provided in association with the first light source, the first power control section controlling the intensity of light emitted from the first light source based on a first light detection signal output from the light detecting section, the first light detection signal indicating the intensity of light emitted from the first light source;

a second power control section provided in association with the second light source, the second power control section controlling the intensity of light emitted from the second light source based on a second light detection signal output from the light detecting section, the second light detection signal indicating the intensity of light emitted from the first light source and the second light source; and a switching section connected to the first power control section and the second power control section, the switching section disabling one of the first power control section and the second power control section while remaining one of the first power control section and the second power control section is enabled.

2. The image forming device according to claim 1, wherein the first power control section and the second power control section control the intensity of light when the light emitted from the first light source and the second light source is directed by the scanning unit toward a portion out of the image forming region of the image bearing member.

3. An image forming device comprising:

a first light source emitting light with an intensity;

a second light source emitting light with an intensity;

a third light source emitting light with an intensity;

a light detecting section that detects light emitted from the first light source, the second light source, and the third light source;

an image bearing member having an image forming region;

a scanning unit that scans the light emitted from the first light source, the second light source, and the third light source on the image bearing member;

a first power control section provided in association with the first light source, the first power control section controlling the intensity of light emitted from the first light source based on a first light detection signal output from the light detecting section, the first light detection signal indicating the intensity of light emitted from the first light source;

a second power control section provided in association with the second light source, the second power control section controlling the intensity of light emitted from the second light source based on a second light detection signal output from the light detecting section, the second light detection signal indicating the intensity of light emitted from the second light source;

a third power control section provided in association with the third light source, the third power control section controlling the intensity of light emitted from the third light source based on a third light detection signal output from the light detecting section, the third light detection signal indicating the intensity of light emitted from the first light source, the second light source, and the third light source;

a first switching section connected to the first power control section and enables the first power control section; and a second switching section connected to the second power control section and enables the second power control section.

4. The image forming device according to claim 3, wherein the first power control section, the second power control section, and the third power control section control the intensity of light when the light emitted from the first light source, the second light source and the third light source are directed by the scanning unit toward a portion out of the image forming region of the image bearing member.

5. The image forming device according to claim 3, further comprising a control section wherein the first switching section and the second switching section are controlled so that the second power control section is disabled while the first power control section is enabled and that the first power control section is disabled while the second power control section is enabled.

6. The image forming device according to claim 5, wherein the third power control section is enabled irrespective of whether the first power control section and the second power control section are enable or disabled.

7. An image forming device comprising:

a first light source emitting light with an intensity;

a second light source emitting light with an intensity;

a light detecting section that detects the light emitted from the first light source and the second light source and outputs a light detection signal having a value that increases as the intensity of light increases;

an image bearing member having an image forming region;

a scanning unit that scans the light emitted from the first light source and the second light source on the image bearing member;

a first light source control section that controls the intensity of light emitted from the first light source in accordance with a first light detection signal output from the light detecting section, the first light detection signal indicating the intensity of light emitted from the first light source, wherein the first light source control section comprises:

a first maximum value storing section that stores a maximum value of the first light detection signal;

a switching section that switches the first maximum value storing section to either a sampling state in which the maximum value is updated or a holding state in which the maximum value is maintained;

a first reference value setting section that sets a first reference value;

a first comparator that compares the maximum value stored in the first maximum value storing section with the first reference value and outputs a first comparison result indicating a difference between the first maximum value and the first reference value; and a first adjusting section that adjusts the intensity of light emitted from the first light source in accordance with the first comparison results;

a second light source control section that controls the intensity of light emitted from the second light source in accordance with a second light detection signal output from the light detecting section, the second light detection signal indicating the intensity of light emitted from both the first and second light sources, wherein the second light source control section comprises:

a second maximum value storing section that stores a maximum value of the second light detection signal;

a second reference value setting section that sets a second reference value;

a second comparator that compares the maximum value stored in the second maximum value storing section with the second reference value and outputs a second comparison result; and a second adjusting section that adjusts the intensity of light emitted from the second light source in accordance with the second comparison result;

a first signal generating section that generates a first command signal, the first light source emitting the light in response to the first command signal;

a second signal generating section that generates a second command signal, the first and second light sources emitting the light in response to the second command signal;

a third signal generating section that outputs a first switching signal to the switching section, the switching section switching the first maximum value storing section to the sampling state in response to the first switching signal, and outputs a second switching signal to the switching section, the switching section switching the first maximum value storing section to the holding state in response to the second switching signal;

a first control section that controls the first signal generating section to output the first command signal, the light emitted from the first light source in response to the first command signal being irradiated onto a portion out of the image forming region of the image bearing member;

a second control section that controls the first and second signal generating sections to simultaneously output the first command signal and the second command signal, the light emitted from the first light source and the second light source in response to the first command signal and the second command signal being irradiated onto a portion out of the image forming region of the image bearing member;

a third control section that controls the third signal generating section to output the first switching signal while only the first signal generating section generates the first command signal; and a fourth control section that controls the third signal generating section to output the second switching signal while the first signal generating section and the second signal generating section simultaneously generate the first command signal and the second command signal.

8. The image forming device according to claim 7, wherein the switching section is connected to the first maximum value storing section.

9. The image forming device according to claim 7, wherein the second reference value is greater than the first reference value.

10. The image forming device according to claim 7, wherein the switching section comprises a switching element connected to the first maximum value storing section and the second maximum value storing section, the switching element performing ON/OFF switching in accordance with control operations to be performed by the third control section and the fourth control section.

11. The image forming device according to claim 7, wherein the light detecting section comprises a detector that receives the light emitted from the first light source and the second light source and a circuit section that provides the light detection signal output from the detector to the first maximum value storing section and the second maximum value storing section.

12. An image forming device comprising:

a plurality of light sources including a specific light source and other light sources;

a light detecting section that detects light emitted from the plurality of the light sources and outputs a light detection signal having a value that increases as the intensity of light increases;

an image bearing member having an image forming region;

a scanning unit that scans the light emitted from the plurality of light sources on the image bearing member;

a plurality of maximum value storing sections that is provided in association with respective ones of the plurality of light sources individually, each maximum value storing section storing a maximum value of the light detection signal indicating the intensity of light emitted only from the associated light source;

a plurality of reference value setting sections that is provided in association with respective ones of the plurality of light sources individually, each reference value setting section setting a reference value;

a plurality of comparators that is provided in association with respective ones of the plurality of light sources individually, each comparator comparing the maximum value stored in the associated first maximum value storing section with the reference value set in the associated reference value setting section and outputting a comparison result indicating a difference between the maximum value and the reference value;

a plurality of adjusting sections that is provided in association with respective ones of the plurality of light sources individually, each adjusting section adjusting the intensity of light emitted from the associated light source in accordance with the comparison result output from the associated comparator;

a plurality of first signal generating sections that is provided in association with respective ones of the plurality of light sources individually, each first signal generating section generating a first command signal, the associated light source emitting the light in response to the first command signal;

a plurality of switching sections that is provided in association with respective ones of said other light sources individually, each switching section switching the associated maximum value storing section to either a sampling state in which the maximum value is updated or a holding state in which the maximum value is maintained;

a plurality of second signal generating sections that is provided in association with respective one of said other light sources individually, each second signal generating section outputting a first switching signal to the associated switching section, the associated switching section switching the maximum value storing section to the sampling state in response to the first switching signal, and outputs a second switching signal to the associated switching section, the associated switching section switching the maximum value storing section to the holding state in response to the second switching signal;

a first control section that controls a plurality of first signal generating sections provided in association with respective ones of said other light sources to output the first command signals according to a time division scheme, the light emitted from said other light sources in response to the first command signals being irradiated onto a portion out of the image forming region of the image bearing member;

a second control section that controls the plurality of first signal generating sections provided in association with the plurality of light sources including the specific light source and said other light sources to output the first command signals simultaneously, the light emitted from the plurality of light sources including the specific light source and said other light sources in response to the first command signals being irradiated onto a portion out of the image forming region of the image bearing member;

a third control section that controls the plurality of second signal generating sections so that a plurality of second signal generating sections in association with a plurality of light sources corresponding to the plurality of first signal generating sections generating the first command signals under the control of the first control section, outputs the first switching signals while the plurality of first signal generating sections generate the first command signals; and a fourth control section that controls the plurality of second signal generating sections to generate the second switching signals while the plurality of first signal generating sections generate the first commend signals simultaneously.

* * * * *